US005153974A

United States Patent [19]

Follens

[11] Patent Number: 5,153,974

[45] Date of Patent: Oct. 13, 1992

[54] HAND TOOL

[75] Inventor: Leopold R. Follens, Bruge, Belgium

[73] Assignee: Select Traders Limited, Gibraltar,

[21] Appl. No.: 826,637

[22] Filed: Jan. 23, 1992

Related U.S. Application Data

[63] Continuation of Ser. No. 599,078, Oct. 17, 1990, abandoned.

[30] Foreign Application Priority Data

Oct. 17, 1989 [GB] United Kingdom ..... 8923414

[51] Int. Cl.[5] ..... B23P 19/02

[52] U.S. Cl. ..... 29/235; 81/44; 7/105

[58] Field of Search ..... 29/235, 270, 278; 81/488, 44; 7/105, 169

[56] References Cited

U.S. PATENT DOCUMENTS 1,016,383 2/1912 Wellman ..... 81/44

*Primary Examiner*—Bruce M. Kisliuk
*Assistant Examiner*—Eileen P. Morgan
*Attorney, Agent, or Firm*—James Creighton Wray

[57] ABSTRACT

A hand tool is insertable between a flexible window-retaining gasket and the frame of the vehicle to separate the gasket from the frame so that a flexible deformable strip material may be fed through the tool and inserted between the gasket and the vehicle. The tool includes a support portion and an end operative portion, offset from the support portion and having included passageway therethrough for the insertion of the deformable strip material. A tool guide portion is provided at the extremity of the tool adjacent the exit point of the passageway.

7 Claims, 2 Drawing Sheets

HAND TOOL

This application is a continuation of Ser. No. 07/599,078, filed Oct. 17, 1990, now abandoned.

BACKGROUND OF THE INVENTION

This invention relates to a hand tool of the kind for insertion between a flexible window-retaining gasket and a frame of a vehicle to separate the gasket from the frame so that a flexible deformable strip material may be fed through the tool and inserted between the gasket and the vehicle, the tool including a support portion and end operative portion, the operative portion being offset from the support portion and having a hole therethrough for insertion of the said flexible deformable strip material.

In car repair operations it is necessary, after the repair has taken place, for the car to be repainted by spraying. In order to get a good finished appearance, it is essential that spraying is limited only to those parts which have to be repainted and that the spray does not go onto other parts. This is particularly important around window areas of vehicles where the bodywork is resprayed but any paint which strays onto the window gaskets gives a very untidy appearance and detracts from the overall finished look of the vehicle. In order to overcome this problem masking tape is generally used over the gasket and this is applied so that it abuts at the junction between the gasket and the frame of the vehicle. Spraying then takes place and any excess spray will end up on the masking material. As the masking material which is usually in the form of a tape, is removed the gasket material below it is revealed without any spray paint particles on it.

The use of a masking tape has a disadvantage that there is a build up of paint at the junction of the masking tape with the vehicle frame and when the tape is removed there is a slight stepped surface at this point. This can only be obliterated by careful hand finishing and sanding. It will be appreciated that such an operation is a time-consuming one and hence adds to the expense of the repair process.

In order to overcome these disadvantages an invention of the kind described above has been devised and is commercially available under the registered trade name of "The Follex System". In this System a selected flexible strip material which is in the form of a plastic tube of a diameter and wall thickness dependent on the nature of the gasket to be dealt with is able to hold the free end of the gasket a sufficient distance from the frame of the vehicle so that masking tape can readily be applied to the gasket to protect it during spraying without the masking tape coming into contact with the vehicle frame itself. Furthermore, spraying takes place effectively under the gasket and up to and onto the flexible tube. As the tube is removed after the spraying operation and discarded there is no problem of unsightly paint spots being left. Any ridge of paint which builds up between the tube and the vehicle frame is underneath the gasket and is hidden from view when the tube is removed and the gasket reverts to its original sealing position. This system is therefore very successful in providing a cheap and effective method of protecting gaskets from being covered in paint during a respraying operation of a vehicle.

The system described is particularly useful for gaskets of a highly flexible nature, but problems have been incurred where stiffer gaskets on certain types of vehicles are encountered and where the tool currently available is not wholly successful in raising the gasket edge. The current tool has a rounded portion which is used to guide the gasket itself but the tool cannot always readily be inserted between the gasket and the frame or guide the flexible material consistently into position. There is therefore a need for an improved form of tool for use with harder types of gasket and it is an object of the present invention to provide such a tool.

SUMMARY OF THE INVENTION

According to the present invention, a hand tool of the kind for insertion between the flexible window-retaining gasket and the frame of the vehicle to separate the gasket from the frame so that a flexible deformable strip material may be fed through the tool and inserted between the gasket and the vehicle includes a support portion and an end operative portion, the end operative portion being offset from the support portion and having a hole therethrough for the insertion of the said flexible deformable strip material, the hole in the operative end portion being at an angle to the general plane of the tool and including a tool guide portion at its extremity adjacent the exit point of the through hole.

The tool guide portion is preferably a laminar section integral with the operative portion and this section may have a curved, pointed or substantially pointed end. The end may lie along the line of the general longitudinal axis of the through hole. The access of the hole may lie at an angle of between 30° and 45° to the general plane of the hand tool. Preferably this angle is between 40° and 43°.

The tool may be provided with an operative portion at each end, the through holes at either end being of different diameters to accommodate different diameter flexible deformable strip materials.

The tool holder is conveniently made from a hard plastics material such as a nylon which is able readily to be injected moulded. The material must be selected so that the laminar strip is given sufficient rigidity so that under normal working conditions it does not break or deform.

The operative portion is generally offset from the support portion by a distance calculated dependent on the type of vehicle to which the tool is to be applied in order to leave a sufficient working space between the vehicle and the tool.

The operative portion may have a curved part which is used to guide the gasket smoothly away from the vehicle.

A tool holder may be provided for the support means and this may either be formed as an integral part of the support means or, preferably, as a detachable part. It may be secured to the support means by any suitable attaching device such as a through screw or a latching flexible clip arrangement.

In order that the invention may be readily understood, one example of a hand tool in accordance therewith will now be described with reference to the five Figures of the accompanying drawings.

DETAILED DESCRIPTION OF THE DRAWINGS

Figure 1:
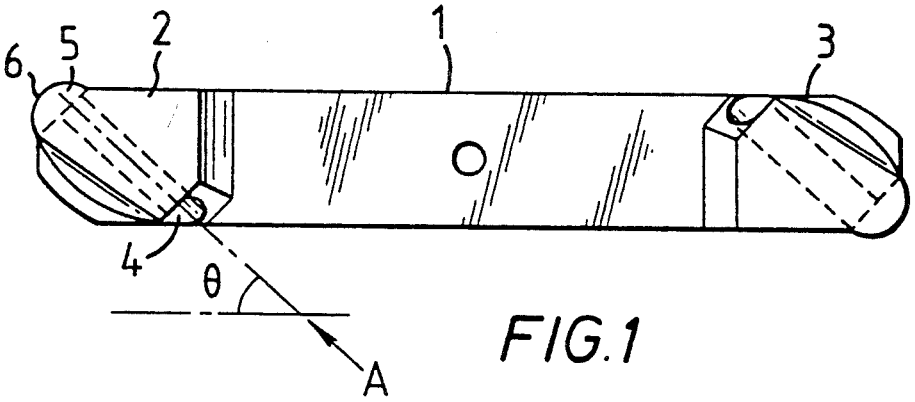
FIG. 1. shows a plan view of the hand tool.
Figure 2:
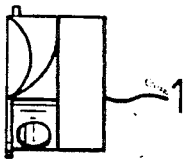
FIGS. 2 and 3 show respectively end views on FIG. 1.

Referring now to the drawings, the hand tool shown is to be used in repairing and refurbishing of motor vehicles after an accident and is to be used for separating a hard gasket, for example around the tail gate window of a vehicle from the frame of the tail gate whilst a flexible tubular strip material of the Follex System is inserted between the gasket and the frame to separate and space the two during respraying.

Figure 3:
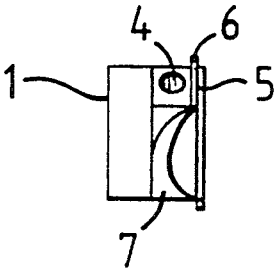
Figure 4:
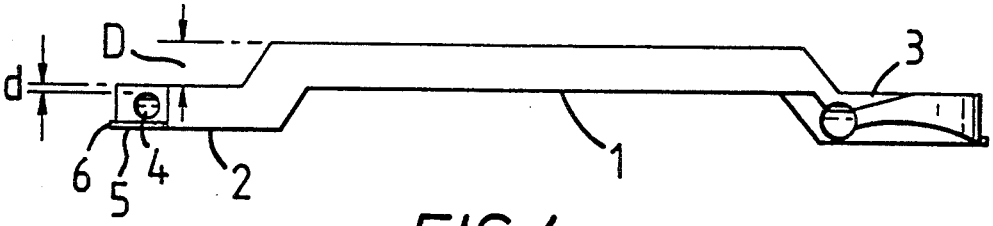
FIG. 4 shows a side view of the tool of FIG. 1.

The tool comprises a central longitudinally extending support portion 1 and two end operative portions, 2 and 3. The two end operative portions, 2 and 3, are identical in construction, except that one is slightly thicker than the other and has a larger bore therethrough. This description only refers to one end operative portion 2, although it will be understood that the end operative portion 3 is substantially identical. The portion 2 is formed on a cranked arm as is shown by FIG. 4 to enable there to be a distance D which is necessary so that the portion 2 can extend over the rim of the frame being worked on and inserted into the gasket. The portion 2 has a through hole or passageway 4 which has its longitudinal axis set at an angle $\theta$ to the longitudinal plane of the tool. The through hole occupies substantially the whole thickness of the portion 2 and there is a relatively thin wall section having a minimum dimension as shown. The entry to the hole 4 is in the direction of the arrow A and at the exit point there is a flat laminar section 5 formed which has a sculpted end i.e. a rounded corner or a pointed end 6 and this corner 6 is substantially in line with the axis of the holes 4. The corner 6 may in a variant be pointed or substantially pointed. As can be seen best in FIG. 3 and FIG. 5, the portion 2 also has a curved section 7 which is used to assist in lifting the gasket.

Figure 5:
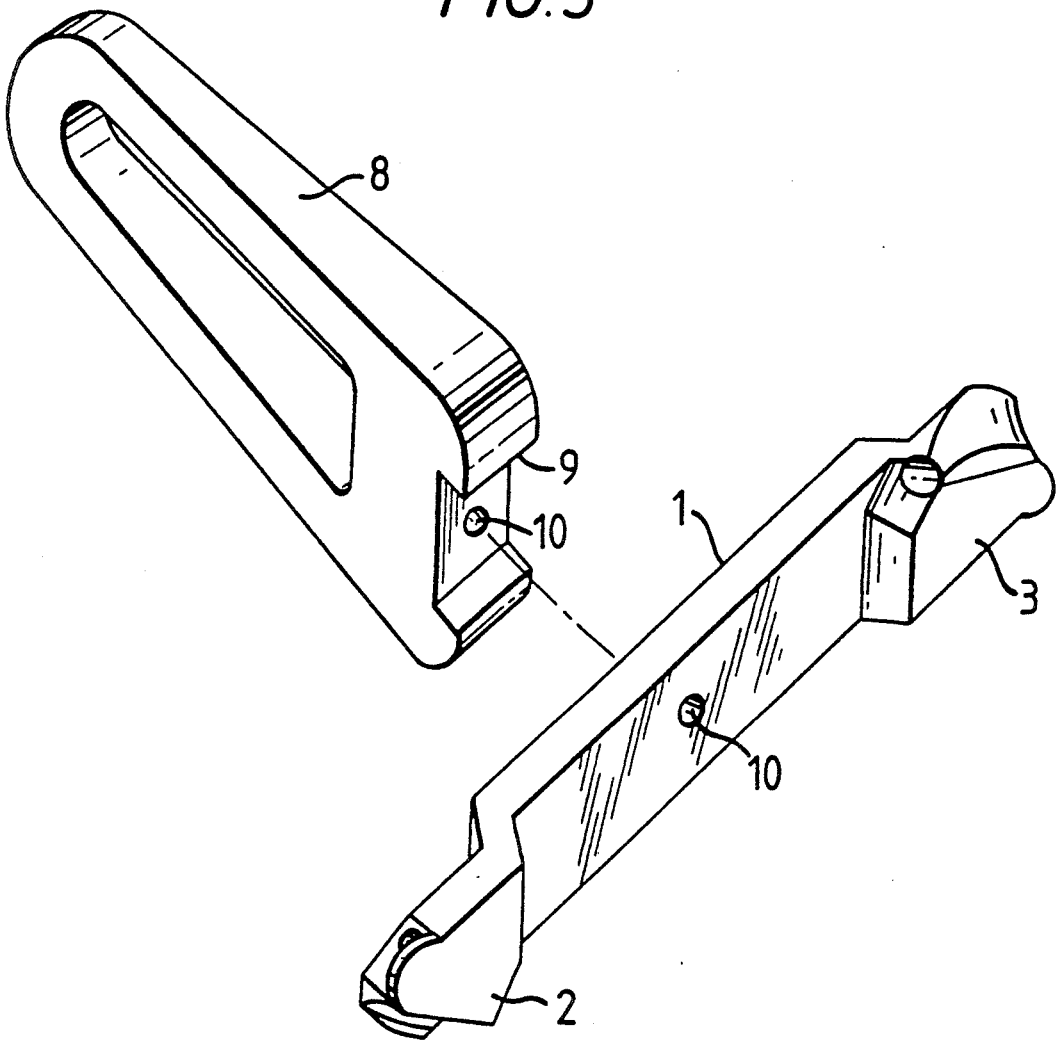
FIG. 5 shows an exploded perspective view of the tool and a suitable holder.

Referring now also to FIG. 5, this shows a holder 8 which has a front recessed portion 9 which can fit over the support portion 1 of the tool. The holder 8 rigidly secures the support portion in position and a screw can be passed through the holes 10 to lock the two parts together securely. The holder is designed so that it can be easily held and moved in use.

In operation with the holder screwed to the portion 2 a flexible hollow strip material of the correct diameter is fed through the hole 4 and the end operative portion 2 is inserted between the gasket and the frame. The effect of the section 5 is to obtain easy entry between the gasket and the frame and to separate the two so that the end portion may enter between them. The laminar section 5 is used as a guide and can control the depth at which the flexible material is fed between the gasket and the frame as the tool is pulled along the frame. The rigidity between the holder 8 and the support portion 2 is important, since it may be desirable to turn the tool to a controlled angle, depending on the particular vehicle type of gasket which is being dealt with.

The tool in this example is made of an injected moulded hard plastics material which is of a nylon base and readily able to be manufactured by a injection moulding process. This enables the tool to be cheaply constructed but to be durable.

A range of tools can be constructed depending on the thicknesses of the flexible strip material to be inserted and the following table gives the relationship between the thickness of the end portion, the hole diameter, the wall thickness and the angle for four end portions:

| Thickness 'D' | Bore Diameter | Wall Thickness 'd' | Angle $\theta$ |
|---|---|---|---|
| 4.0 | 2.7 | 0.65 | 40 |
| 5.0 | 3.4 | 0.80 | 41 |
| 6.1 | 4.3 | 0.90 | 42 |
| 7.2 | 5.4 | 0.90 | 43 |

All aimensions in mm
Bore length in all cases is 129 mm

As can be seen from the above table, the angle $\theta$ is preferably set at an angle between 40° and 43°, although a range of between 30° and 45° can be used effectively, depending on the particular application and selection of flexible strip materials.

The invention provides, therefore, an improved hand tool which enables a system, such as the Follex System, to be applied to a wide range of vehicles, particularly those including hard gaskets. The tool is cheap to manufacture and effective and durable in its application.

We claim:

1. A hand tool of the kind for insertion between a flexible window-retaining gasket and a frame of a vehicle to separate the gasket from the frame so that a flexible deformable strip material may be fed through the tool and inserted between the gasket and the vehicle, in which the tool includes a central longitudinally extending elongate support portion which has an upper surface defining a longitudinal plane and having first and second ends, at least one of said ends having an operative end portion, the end operative portion being offset from the support portion and lying in a plane parallel to the longitudinal plane and having a passageway therein for insertion of said flexible deformable strip material, the passageway having a longitudinal axis at an angle to the longitudinal plane of the tool, and further includes a tool guide portion insertable between the gasket and the frame, the tool guide portion being at an extremity adjacent an exit point of the passageway, wherein the tool guide portion is provided with a rounded end.

2. A hand tool as claimed in claim 1 in which the tool guide portion is a laminar section integral with the operative end portion.

3. A hand tool as claimed in claim 1 in which the passageway has its longitudinal axis set at an angle of between 30° and 45° to the longitudinal plane of the tool.

4. A hand tool as claimed in claim 3 wherein the longitudinal axis of the passageway is set at an angle of between 40° and 43° to the longitudinal plane of the tool.

5. A hand tool as claimed in claim 1 in which the tool is provided with an operative portion having a passageway at each end, the passageways at either end being of different diameters to accommodate different diameter flexible deformable strip materials.

6. A tool as claimed in claim 1 in which the operative portion is offset from the support portion by a distance dependent on the type of vehicle to which the tool is to be applied in order to leave a sufficient working space between the vehicle and the tool.

7. A tool as claimed in claim 1 in which the operative portion has a curved part which is used to lift the gasket smoothly away from the vehicle, after the guide portion is inserted between the gasket and the frame of the vehicle.

* * * * *